US006878073B2

(12) United States Patent
Takeda

(10) Patent No.: US 6,878,073 B2
(45) Date of Patent: Apr. 12, 2005

(54) WOOD GOLF CLUB

(75) Inventor: Hitoshi Takeda, Tsubame (JP)

(73) Assignee: K.K. Endo Seisakusho, Niigata-ken (JP)

( * ) Notice: Subject to any disclaimer, the term of this patent is extended or adjusted under 35 U.S.C. 154(b) by 78 days.

(21) Appl. No.: 09/893,796

(22) Filed: Jun. 28, 2001

(65) Prior Publication Data

US 2002/0022535 A1 Feb. 21, 2002

Related U.S. Application Data

(63) Continuation-in-part of application No. 09/395,664, filed on Sep. 14, 1999, now abandoned.

(51) Int. Cl.[7] ..... A63B 53/04
(52) U.S. Cl. ..... 473/346; 473/345
(58) Field of Search ..... 473/324, 329, 473/332, 342, 345, 346, 350, 305

(56) References Cited

U.S. PATENT DOCUMENTS 3,084,940 A * 4/1963 Cissel ..... 473/332
4,681,321 A * 7/1987 Chen et al. ..... 473/332
5,106,094 A * 4/1992 Desbiolles et al. ..... 473/342
5,431,396 A * 7/1995 Shieh ..... 473/329
5,547,427 A * 8/1996 Rigal et al. ..... 473/345
RE35,955 E * 11/1998 Lu ..... 473/329
5,839,975 A * 11/1998 Lundberg ..... 473/346
5,941,782 A * 8/1999 Cook ..... 473/346
6,162,133 A * 12/2000 Peterson ..... 473/345

* cited by examiner

*Primary Examiner*—Glenn Caldarola
*Assistant Examiner*—Tom Duong
(74) *Attorney, Agent, or Firm*—Quarles & Brady LLP

(57) ABSTRACT

A wood golf club called a metal wood which suppresses the deformation of a head body at the time of impact, thereby effectively elastically deforming a face to thereby elongate a travelling distance of a ball. An outer shell of a head 1 is constructed of metallic shell members, thus defining a hollow interior 11 inside the head 1. A tabular reinforcing member 20 is provided nearly along a cross-sectional area of the hollow interior 11 defined in a toe-to-heel direction, a preset distance away from the face 2. Thus, the deformation of a sole 4 and a crown 5 can be suppressed, while permitting the sufficient elastic deformation of the face 2.

6 Claims, 6 Drawing Sheets

WOOD GOLF CLUB

CROSS REFERENCE TO RELATED APPLICATIONS

This application is a continuation-in-part application of U.S. application Ser. No. 09/395,664 filed on Sep. 14, 1999, formerly and now abandoned.

BACKGROUND OF INVENTION

1. Field of the Invention

The present invention relates to a hollow, metallic wood golf club, called a metal wood, particularly to the structure of a head thereof.

2. Prior Art

A head of a so-called metal wood club is constructed of metallic shell members made for example of titanium, thus defining a hollow interior. The hollow interior is, depending on cases, filled with foaming resin, such as hard urethane foam.

A golf club head is subjected to elastic deformation due to impact developed by striking balls. For conventional golf clubs, a face shell, a crown shell and a sole shell would be all elastically deformed due to the impact. As a face is to contact balls, elastic forces due to the deformation thereof will contribute to enhancing the initial travelling speed of balls and elongating the travelling distances thereof. Accordingly, a face need to be effectively deformed. For the deformation of a sole and a crown which construct a head body, however, the deformation thereof will hinder the effective deformation of the face, so that so-called loss of power would take place. Thus, rigid soles and crowns are desirable.

Conventionally, there is proposed a metal wood head in Japanese Patent Un-Examined Publication No. 60-36074, in which a nearly L-shaped reinforcing member is welded to the inside of shells along a sole and a face. Further, U.S. Pat. No. 5,467,983 to Chen discloses that a face reinforcing member is provided on a rear surface of the face to reinforce the same. With such reinforcing member, however, not only a head body but also a face is kept from being deformed, and thus no effective elasticity of a face would be generated at impact.

SUMMARY OF THE INVENTION

To eliminate the above-mentioned problems, it is, therefore, an object of the present invention to provide a wood golf club normally called metal wood, in which a face is effectively elastically deformed by suppressing the excessive deformation of a head body, thereby increasing the travelling distance of balls.

It is another object of the present invention to provide such wood golf club without providing a conventional rib structure on a rear surface of the face.

To attain the above object, there is provided a wood golf club which comprises: a head having a face on a front, said head defining a toe at one end of the face and a heel at the other end thereof, having an outer shell made of metallic shells, defining a hollow interior; a shaft connected to a heel side of the head; and one or more reinforcing members provided separately inside said outer shell of the head, each of said reinforcing members being tabular, projecting toward the hollow interior, so formed that it is provided nearly along a cross-sectional area of said hollow interior defined in a toe-to-heel direction, a preset distance away from the face to define a preset space therebetween, wherein each reinforcing member is frame-shaped and makes up 20% or more of the cross-sectional area of the hollow interior in a toe-to-heel direction.

With the structure, when striking a ball on the face, some portions of the head which are positioned rearwardly of the reinforcing members are subjected to less deformation. In other words, the deformation of the sole and the crown which construct the body portion of the head is suppressed, while the effective flexibility of the face is insured, thus elongating a travelling distance of balls.

Further, as the reinforcing member is frame-shaped, the reinforcing member can be lightened, thus realizing the lightening of the whole head. On the other hand, if the reinforcing member is frame-shaped, then the above-mentioned deformation-suppression effect would decrease. Therefore, the reinforcing member should desirably make up 20% or more of the cross-sectional area of the hollow interior defined in a toe-to-heel direction, in order to obtain the deformation-suppression effect to a satisfactory extent.

From another aspect of the invention, there is provided a wood golf club according to the foregoing aspect, wherein said reinforcing member is positioned rearwardly of a shaft connecting portion of said head, in a range of ±20% of a distance defined from the face to a rearmost side of the head, with an intermediate position between the face to the rearmost side of the head being assumed to be a reference position To ensure the suppressing of the deformation of the body portion of the head, the reinforcing member should be positioned in the vicinity of the intermediate position between the face and the rearmost side of the head. In the event that the shaft connecting portion of the head becomes an obstacle to providing the reinforcing members, yet the reinforcing members may be provided in a range of ±20% of a distance defined from the face to a rearmost side of the head, with an intermediate position between the face to the rearmost side of the head being assumed to be a reference position, whereby the deformation of the body portion of the head can be suppressed effectively enough.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which.

DETAILED DESCRIPTION OF THE INVENTION

Figure 1:
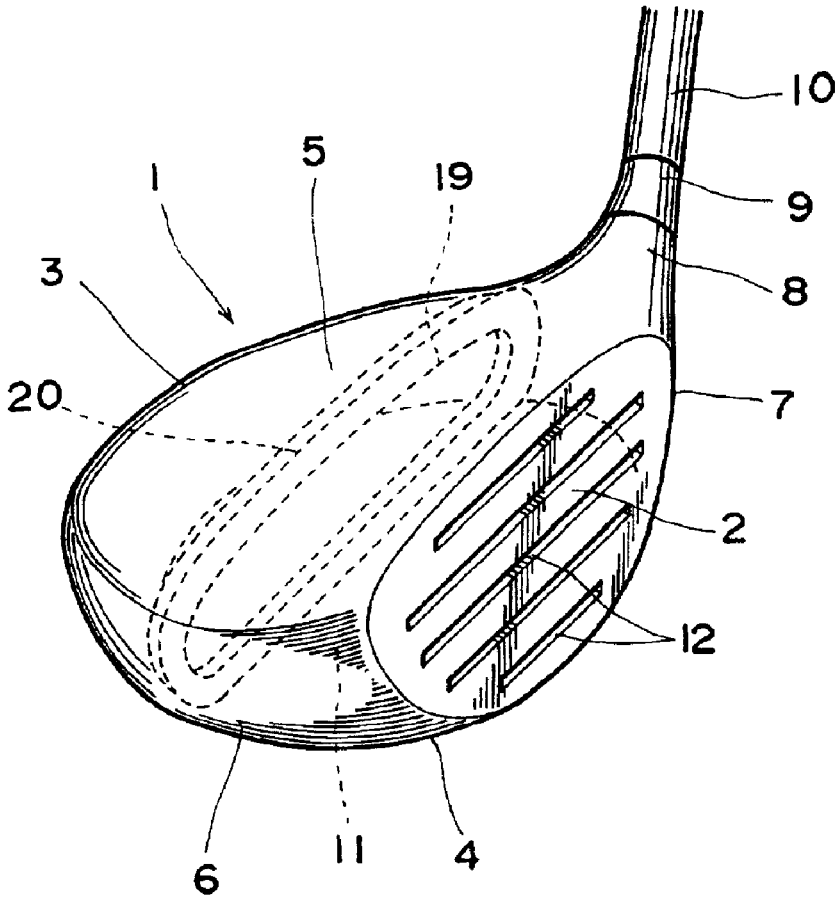
FIG. 1 is a perspective view showing a wood golf club in accordance with a first embodiment of the invention.
Figure 2:
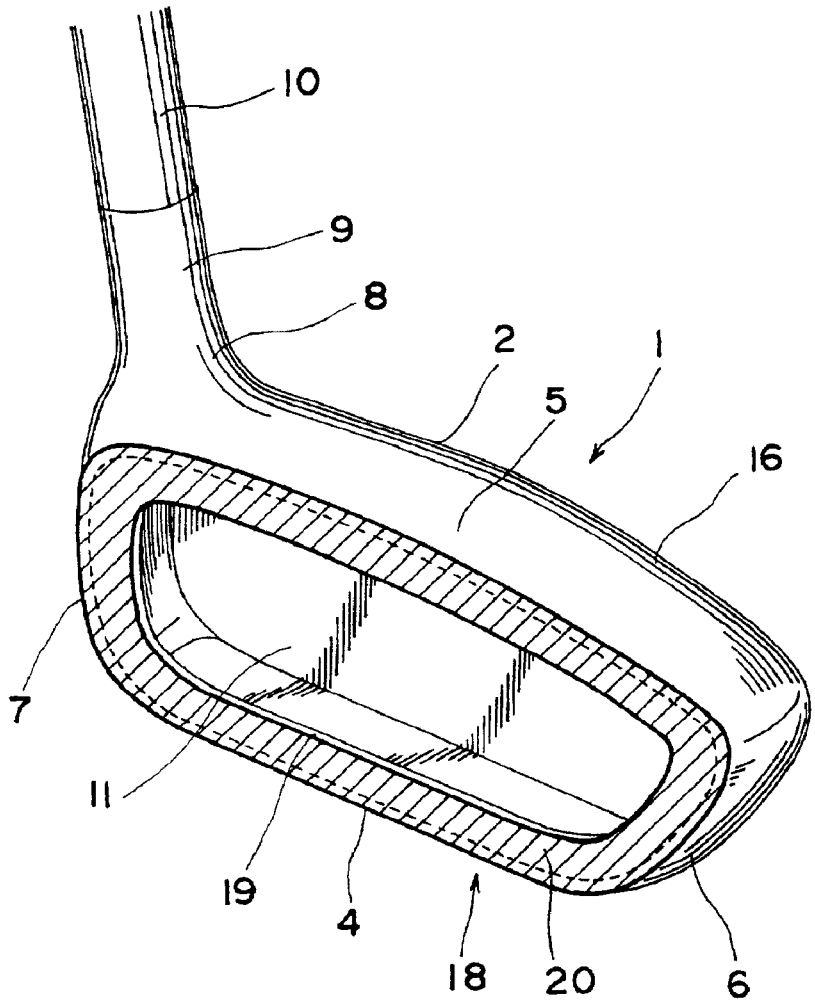
FIG. 2 is a partially cutaway perspective view showing a wood golf club of FIG. 1.

Hereinafter is explained a first embodiment of the invention with reference to FIGS. 1 through 3.

A wood golf club according to the present embodiment has a head 1 which is hollow and metallic, and thus it is a so-called metal wood. The head 1 comprises a ball-striking face 2 on its front face, a back 3 on its back, a sole 4 in its lower part, a crown 5 in its upper part, a toe 6 at one side and a heel 7 at an other side, respectively. The upper portion of the heel 7 is formed with a neck 8, from which extends obliquely upwards a hosel 9. The hosel 9 serves as a shaft connector for connecting a shaft 10 thereto. The head 1 has a hollow interior 11, which may be filled with filler such as polyurethane. The face 2 is formed with a plurality of grooves called score lines 12.

The outer shell of the head 1 consists of two pieces, i.e., a front piece or face shell member 16 and a back piece or body shell member 17. Between the shell members 16 and 17 is provided a plate member 18 which is plate-shaped or tabular. These shell members 16, 17 and the plate member 18 are formed from a metal such as titanium or titanium alloy, which are each formed by suitable means such as press-working including forging, casting or machining so that they are joined together by welding or the like.

The face shell member 16 makes up the face 2, the front and minority portions of the sole 4 and the crown 5 as well as the neck 8 and hosel 9, which is open towards a rear side, being receptacle-shaped. The body shell member 17 makes up the body portion of the head 1, namely, the back 3 and the back and majority portions of the sole 4 and the crown 5, which is open towards a front side, being also receptacle-shaped. The reason for having allowed the face shell member 16 to make up the front portions of the sole 4 and the crown 5 is to have the same shell member 16 make up the neck 8 and the hosel 9 as well, and thus the transverse dimension of the face shell member 16 is set at minimum value to construct the neck and the hosel 9.

Figure 3:
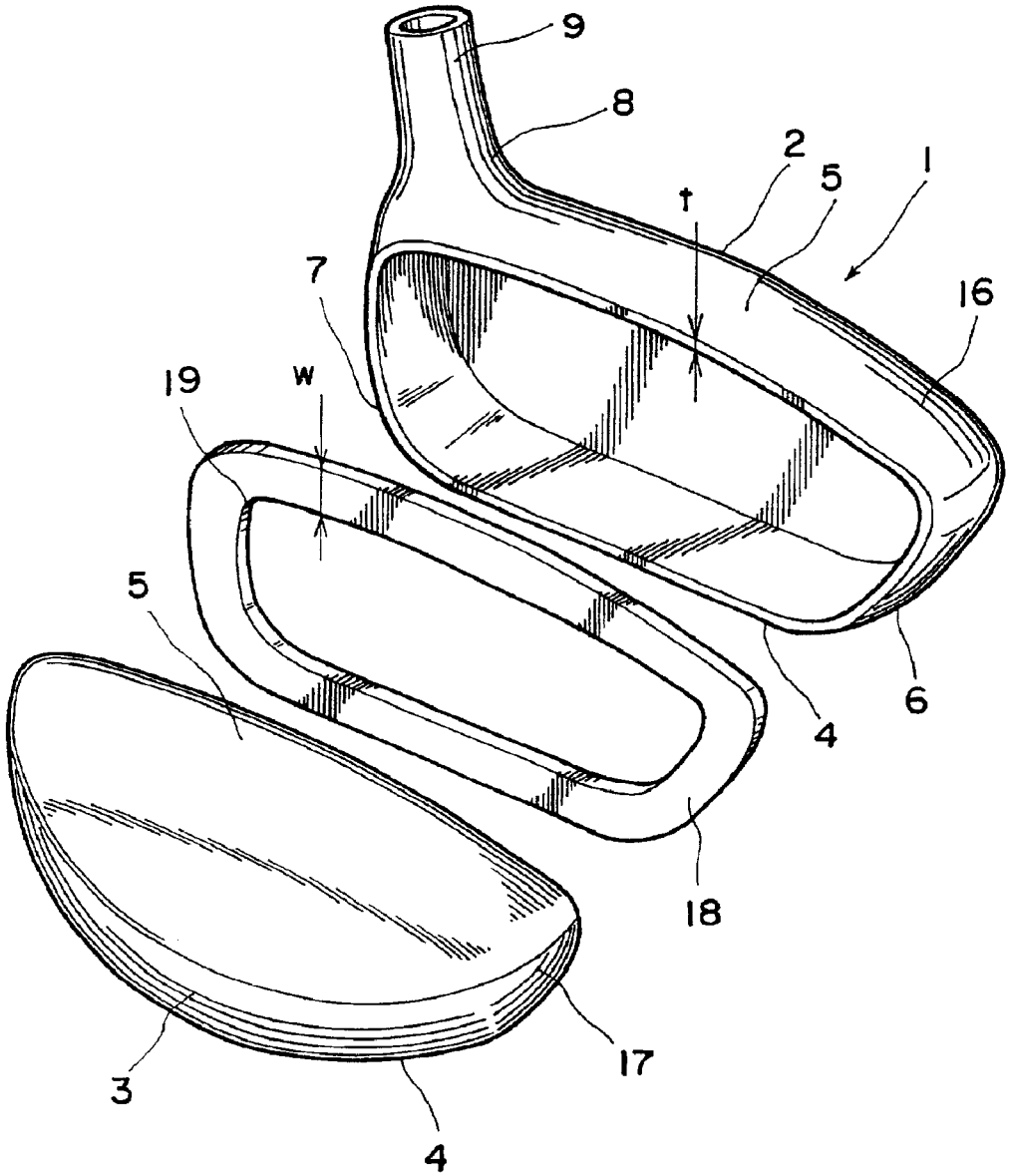
FIG. 3 is an exploded perspective view showing a wood golf club of FIG. 1.

The aforesaid plate member 18 is frame-shaped, having an opening 19 in the center thereof, and the width "w" thereof is greater than the thickness "t" of the shell members 16 and 17, as shown in FIG. 3. As the external configurations of the shell members 16, 17 and the plate member 18 shall be the same as far as the portions where they are joined together are concerned, the inner peripheral portion of the plate member 18 is allowed to project toward the hollow interior 11, thereby constructing a reinforcing member 20. The reinforcing member 20 is so shaped that it may be provided nearly along a cross-sectional area of the hollow interior 11 defined in a toe to heel direction, a certain distance away from the face 2, and thus makes up 20% or more of the cross-sectional area. In addition, the reinforcing member 20 is positioned in the vicinity of the intermediate position between the face 2 and the rearmost side of the back 3. Preferably, the reinforcing member 20 is positioned in a range of ±20% of a distance defined from the face 2 to a rearmost side of the head 1, with an intermediate position between the face 2 to the rearmost side of the head 1 being assumed to be a reference position. More specifically, the distance from the face 2 to the rearmost side of the head 1 is defined as a distance from a tip end of a leading edge to the rearmost end of the back 3, assuming that the face angle is zero degree.

Hereinafter is explained how the above-mentioned structure actually works. At the time of impact or when a ball is struck on the face 2, the portions positioned rearwardly of the reinforcing member 20 is less subjected to deformation due to the same. In other words, the sole 4 and the crown 5 which construct the body portion of the head 1 are rigidly supported by the reinforcing member 20, thus suppressing the deformation thereof. Accordingly, the unnecessary deformation of the head body is prevented so that energy generated at the time of ball-impact is dedicated to the deformation of the face 2 of the face shell member 16. As a result, the face 2 is elastically deformed in an effective manner, thereby realizing greater initial travelling speed of balls as well as elongated travelling distances of balls.

Generally speaking, to ensure the suppressing of the deformation of the body portion of the head 1, the reinforcing member 20 should be positioned in the vicinity of the intermediate position between the face and the rearmost side of the head. Further, as a certain space or clearance is necessary between the face 2 of the face shell member 16 and the reinforcing member 20 in order to allow the face 2 to deform elastically enough to impart suitable elastic force to struck balls, a space adjacent to the rear surface of the face 2 is kept hollow so that any member may not contact the same. Further, as the reinforcing member 20 is frame-shaped in the present embodiment, the interior of the head 1 is not partitioned by anything so that it may define a continuous hollow space.

Incidentally, in the event that the shaft connecting portion of the head 1 becomes an obstacle to providing the reinforcing members 20, yet the reinforcing members 20 may be provided in a range of ±20% of a distance defined from the face 2 to a rearmost side of the head 1, with an intermediate position between the face 2 to the rearmost side of the head 1 being assumed to be a reference position, whereby the deformation of the body portion of the head can be suppressed effectively enough.

Further, as the reinforcing member 20 is frame-shaped, the reinforcing member 20 can be lightened, thus realizing the lightening of the whole head 1. As a result, the head 1 can be large-sized through the lightening of the head 1. If the head 1 is large-sized, then the area of the face 2 will be increased, thus enlarging so-called sweet area. On the other hand, if the reinforcing member 20 is frame-shaped, then the above-mentioned deformation-suppression effect would decrease. Therefore, the reinforcing member 20 should desirably make up 20% or more of the cross-sectional area of the hollow interior 11 defined in a toe-to-heel direction, in order to obtain the deformation-suppression effect to a satisfactory extent.

Figure 4:
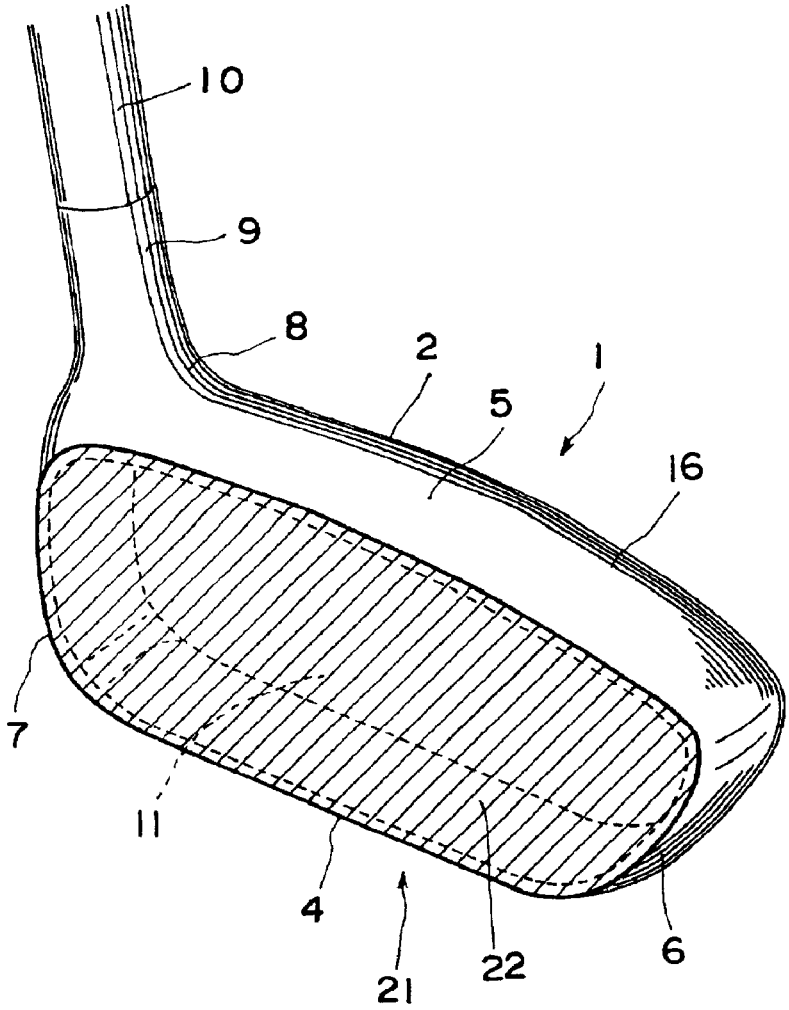
FIG. 4 is a partially cutaway perspective view showing a wood golf club in accordance with a second embodiment of the invention.
Figure 5:
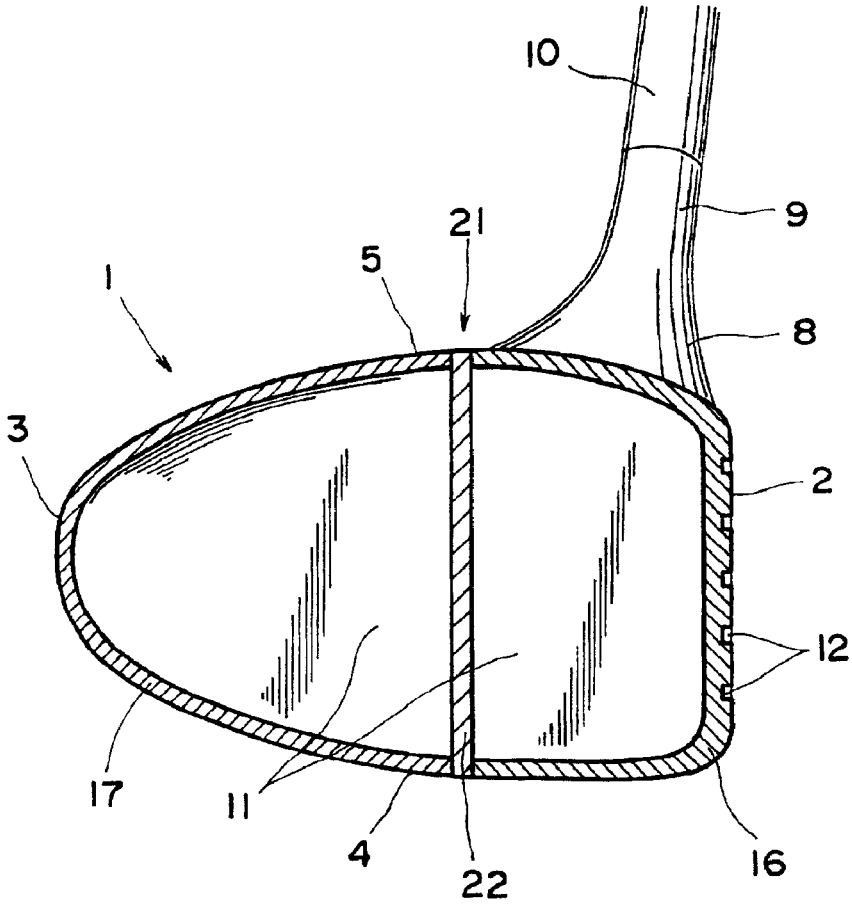
FIG. 5 is a section of a wood golf club of FIG. 4.

Next, a second embodiment of the invention is explained with reference to FIGS. 4 and 5. As the second embodiment includes the same structure as the foregoing first embodiment except the configuration of the plate member and the reinforcing member, the same portions as those described in the first embodiment will be designated by the same reference numerals, and their repeated descriptions will be omitted.

In the second embodiment is provided a plate member 21 which is tabular, including no openings therein. Accordingly, a reinforcing member 22 formed by the plate member 21 is also tabular, having no openings. As a result, the reinforcing member 22 occupies the entire cross-sectional area of the hollow interior 11 of the head 1 in the toe-to-heel direction, thereby dividing the hollow interior 11 into front and rear parts.

With such closed and tabular reinforcing member 22, as is in the second embodiment, the strength of the reinforcing member 22 itself is enhanced. Accordingly, it is possible to more effectively prevent the body portion of the head 1 such as the sole 4 and the crown 5 from being deformed.

Figure 6:
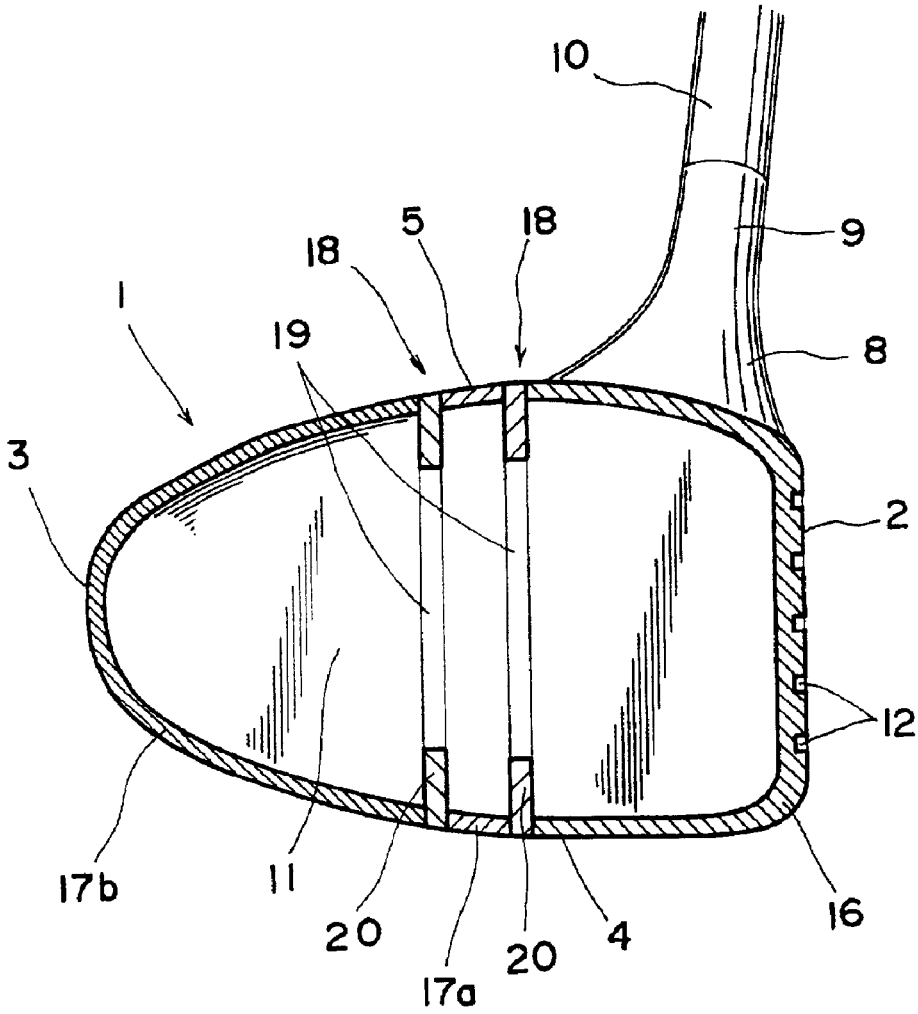
FIG. 6 is a section showing a wood golf club in accordance with a third embodiment of the invention.

Next, a third embodiment of the invention is explained with reference to FIG. 6. Likewise, the same portions as those described in the foregoing embodiments will be designated by the same reference numerals, and their repeated descriptions will be omitted.

In the third embodiment are provided two reinforcing members 20 which are disposed in parallel from front toward back so that the head 1 is divided into three parts. The face shell member 16 is of the same structure as that of the first embodiment, while the body shell member 17 of the first embodiment is divided into a front section and a rear section, i.e., a first body shell member 17*a* which has an opening on both sides and a second body shell member 17*b* which has an opening on a front side only. The reinforcing members 20 are each structured by providing the plate member 18 between the shell members 16 and 17*a*, or the shell members 17*a* and 17*b*, then joining them together.

With the two reinforcing members 20 thus provided, the reinforcing effect will be further enhanced, thereby more effectively suppressing the deformation of the body portion of the head such as the sole 4 and the crown 5. It should be noted that the number of the reinforcing members does not have to be limited to either one, as proposed in the first and second embodiments, or two as in the third embodiment, but may be three or more. In the event that a plurality of reinforcing members are provided, they are to be arranged from front toward back.

Incidentally, the present invention should not be limited to the foregoing embodiments, but may be modified within a scope of the invention. For example, whilst the shell members 16 and 17 that construct the outer shell of the head 1 are separate from the plate members 18, 21 that construct the reinforcing members 20, 22 in the foregoing embodiments, the reinforcing members can be formed integrally with the shell members that construct the outer shell of the head, if the outer shell of the head is for example constructed by the increased number of the shell members. For example, one of the reinforcing members 20 in the third embodiment may be formed integrally with the aforesaid intermediate first body shell member 17*a*. Further, whilst the outer shell of the head 1 is divided in a manner that takes the positions of the plate members 18, 21 as a boundary so that the plate members 18, 21 are sandwiched between the respective shell members 16, 17, 17*a* and 17*b* in the foregoing embodiments, the positions where the outer shell of the head is to be divided should not always correspond with those of the reinforcing members, but the reinforcing members may be joined to the inside of the shell members. It should be noted, however, that the above-mentioned divisional structure according to the foregoing embodiments would make the manufacture of a golf club easier.

What is claimed:

1. A wood golf club which comprises:

a head having a face on a front, said head defining a toe at one end of the face and a heel at the other end thereof, having an outer shell made of metallic shells, defining a hollow interior, said head also having a rearmost side opposite the face on the front;

a shaft connected to a heel side of the head; and one or more reinforcing members provided separately inside said outer shell of the head, each of said reinforcing members being tabular, projecting toward the hollow interior, so formed that it is provided nearly along a cross-sectional area of said hollow interior defined in a toe-to-heel direction, a preset distance away from the face to define a preset space therebetween, wherein:

each reinforcing member is frame-shaped, having an opening on a center portion thereof, and makes up 20% or more of the cross-sectional area of the hollow interior in a toe-to-heel direction;

said reinforcing member is positioned rearwardly of a shaft connecting portion of said head in a range of ±20% of a distance extending between said face on the front and said rearmost side of the head, with an intermediate position between the face to the rearmost side of the head being assumed to be a reference position;

said reinforcing member and said face are provided essentially in parallel with each other; and said preset space adjacent to a rear surface of said face remains hollow so that said face may bend upon striking of a ball.

2. A wood golf club according to claim 1, wherein said outer shell of the head consists of a face shell member that forms a front portion of the head and a body shell member that constructs a rear portion thereof, while said reinforcing member is formed by providing a plate member between the face shell member and the body shell member.

3. A wood golf club according to claim 1, wherein a plurality of said reinforcing members are provided so that they are arranged from front to back of the head.

4. A wood golf club according to claim 3, wherein said outer shell of the head consists of the face shell member that forms the face, a first body shell member located rearwardly of the face shell member and a second body shell member located rearwardly of the first body shell member, while said reinforcing members are formed by providing the plate member between the face shell member and the first body shell member, and between the first body shell member and the second body shell member, respectively.

5. A wood golf club according to claim 3, wherein said outer shell of the head consists of the face shell member that forms the face, a first body shell member located rearwardly of the face shell member and a second body shell member located rearwardly of the first body shell member, while said reinforcing member is formed integrally with said first body shell member.

6. A wood golf club according to claim 1, wherein said metallic shells and reinforcing member are formed by forging process.

* * * * *